US009410767B2

(12) United States Patent
Tyybakinoja et al.

(10) Patent No.: US 9,410,767 B2
(45) Date of Patent: Aug. 9, 2016

(54) HOLSTER

(75) Inventors: Jarno Tyybakinoja, Helsinki (FI); Sami Helle, Helsinki (FI)

(73) Assignee: HOLSTER TECH FINLAND OY, Helsinki (FI)

( * ) Notice: Subject to any disclaimer, the term of this patent is extended or adjusted under 35 U.S.C. 154(b) by 670 days.

(21) Appl. No.: 13/989,484

(22) PCT Filed: Dec. 5, 2011

(86) PCT No.: PCT/FI2011/051077
§ 371 (c)(1),
(2), (4) Date: May 24, 2013

(87) PCT Pub. No.: WO2012/076754
PCT Pub. Date: Jun. 14, 2012

(65) Prior Publication Data

US 2013/0240582 A1 Sep. 19, 2013

(30) Foreign Application Priority Data

Dec. 8, 2010 (FI) ..... 20106299

(51) Int. Cl.
*F41C 33/02* (2006.01)

(52) U.S. Cl.
CPC ..... *F41C 33/02* (2013.01); *F41C 33/0236* (2013.01); *F41C 33/0263* (2013.01)

(58) Field of Classification Search
CPC ..... F41C 33/0263; F41C 33/0209; F41C 33/0227; F41C 33/254; F41C 33/02; F41C 33/0236
USPC ..... 224/244, 243, 198, 192–193
See application file for complete search history.

(56) References Cited

U.S. PATENT DOCUMENTS

| | | | | |
|---|---|---|---|---|
| 2,349,376 | A * | 5/1944 | Ray | F41C 33/0209 224/244 |
| 4,256,243 | A | 3/1981 | Bianchi et al. | |
| 4,277,007 | A | 7/1981 | Bianchi et al. | |
| 4,846,384 | A | 7/1989 | Perry | |
| 5,048,735 | A * | 9/1991 | McCormick | F41C 33/0263 224/244 |
| 5,810,221 | A | 9/1998 | Beletsky et al. | |
| 5,918,784 | A | 7/1999 | Serpa | |
| 5,961,013 | A | 10/1999 | Collins | |
| 7,556,181 | B2 * | 7/2009 | Spielberger | F41C 33/0245 224/243 |
| 8,235,263 | B1 * | 8/2012 | Yeates | F41C 33/0227 224/193 |
| 8,474,670 | B1 * | 7/2013 | Gregory | F41C 33/0263 224/243 |
| 8,720,755 | B2 * | 5/2014 | Gregory | F41C 33/0263 224/244 |

(Continued)

OTHER PUBLICATIONS

International Search Report in PCT/FI2011/051077 dated Jan. 3, 2012.

*Primary Examiner* — Justin Larson
*Assistant Examiner* — Peter Helvey
(74) *Attorney, Agent, or Firm* — Fildes & Outland, P.C.

(57) ABSTRACT

A holster for a pistol, in which pistol there is a grip, a barrel, a trigger, and a trigger guard, includes a rigid case partly surrounding at least the barrel and the trigger guard, and a belt clip for carrying the case on the belt of the user at the side of their hip, and a locking mechanism integrated in the case for locking the pistol into it, which locking mechanism further includes an arm and a catch for securing the trigger guard to the case. The arm is pivoted to the outer surface of the case with the aid of a shaft perpendicular to the side of the case, in order to release the locking mechanism, and the holster further includes a catch-opening formed in the surface of the case, in order to lock the locking mechanism.

15 Claims, 14 Drawing Sheets

(56) References Cited

U.S. PATENT DOCUMENTS

2002/0158095 A1* 10/2002 Vor Keller ..... E05B 47/0603 224/244
2005/0279788 A1* 12/2005 Lowe ..... F41C 33/0209 224/244
2006/0226185 A1 10/2006 Har-Shen
2009/0014484 A1* 1/2009 Spielberger ..... F41C 33/0263 224/196
2009/0224014 A1* 9/2009 Kumuchian ..... F41C 33/0263 224/244
2009/0321480 A1* 12/2009 Kincaid ..... F41C 33/0263 224/243
2011/0101063 A1* 5/2011 Zusman ..... F41C 33/0227 224/682
2011/0163138 A1* 7/2011 Tyybakinoja ..... F41C 33/0263 224/244
2011/0168748 A1* 7/2011 Benes ..... F41C 33/0236 224/244
2013/0075435 A1* 3/2013 Hellweg ..... F41C 33/0227 224/243
2013/0306691 A1* 11/2013 Baumann ..... F41C 33/0263 224/244
2014/0291363 A1* 10/2014 Clifton, Jr. ..... F41C 33/0263 224/244
2014/0305975 A1* 10/2014 Ribas ..... F41C 33/0263 224/244
2015/0184978 A1* 7/2015 Hedeen ..... F41G 1/35 42/114
2015/0247701 A1* 9/2015 Faifer ..... F41C 33/0209 224/244
2015/0345898 A1* 12/2015 Bardy ..... F41C 33/02 224/244
2015/0345899 A1* 12/2015 Bardy ..... F41C 33/0236 224/243

* cited by examiner

HOLSTER

TECHNICAL FIELD

The present invention relates to a holster for a pistol, in which pistol there is a grip, a barrel, a trigger, and a trigger guard, which holster includes a rigid case partly surrounding at least the barrel and the trigger guard, in the upper part of which there is an opening for pushing the pistol barrel-first into it, thus forming a path for the trigger guard, a belt clip for carrying the case on the belt of the user, a locking mechanism integrated in the case for locking the pistol into it, which locking mechanism further includes an arm pivoted with the aid of a shaft on the outer surface of the case and a catch formed at one end of the arm, arranged to move in front of, and away from the trigger guard with the aid of a deflection of the arm essentially perpendicular to the plane formed by the side of the case, which catch includes a first bevelled surface arranged to fit the trigger guard, for moving the catch away from the path into order to push the pistol into the case, and a first counter-surface for securing the pistol to the case by the trigger guard, an opening formed in the surface of the case, for guiding the catch inside the trigger guard.

BACKGROUND OF THE INVENTION

Numerous different pistol holsters are known from the prior art. Many are of a kind in which the pistol is in no way locked into the holster and is exposed to attempted theft. Various pistol holsters equipped with locking mechanisms are also known from the prior art. In these, the locking mechanisms are often difficult and complex, so that they are difficult to use and the holster becomes large and heavy.

Also known from the prior art is patent publication U.S. Pat. No. 5,918,784, which discloses one pistol holster and its pistol locking mechanism. A problem with a construction of this kind is the dirt that accumulates between the locking catch, which can jam the locking catch, so that the pistol cannot be removed from the holster. In addition, a problem in this solution is that the trigger finger is used to open the locking of the holster, so that in crisis situations accidents have occurred to users when they have also accidentally pulled the trigger when removing the pistol from the holster.

SUMMARY OF THE INVENTION

The invention is intended to create a different type of holster for a pistol, which is simple, reliable, and small in size. The characteristic features of the present invention in which pistol there is a grip, a barrel, a trigger, and a trigger guard. The holster comprises a rigid case partly surrounding at least the barrel and the trigger guard, the case having an upper part, an outer surface and a side, and in the upper part of the case there is an opening for pushing the pistol barrel-first into it, thus forming a path for the trigger guard, a belt clip for carrying the case on the belt of the user. A locking mechanism is integrated in the case for locking the pistol into it, the locking mechanism further comprising an arm pivoted with the aid of a shaft to the outer surface of the case and a catch formed at one end of the arm, arranged for moving in front of, and away from the trigger guard with the aid of a deflection of the arm in a direction essentially perpendicular to the plane formed by the side of the case. The catch comprising a first bevelled surface arranged to fit the trigger guard, for moving the catch away from the said path in order to push the pistol into the case, and a first counter-surface for securing the pistol to the case by the trigger guard. A catch-opening is formed in the surface of the case, for guiding the catch inside the trigger guard, wherein the shaft is perpendicular to the said plane and the arm is arranged to rotate around the shaft on essentially the said plane in order to release the locking mechanism with the aid of the movement of the user's hand, and the catch comprising a second bevelled surface for guiding the catch away from inside the trigger guard with the aid of the said rotation.

This intention can be achieved by means of the holster according to the invention for a pistol, in which pistol there is a grip, a barrel, a trigger, and a trigger guard. The holster according to the invention includes a rigid case partly surrounding at least the barrel and trigger guard, and in which there is an opening in the upper part for pushing the pistol barrel-first into it, thus forming a path for the trigger guard. The case also includes a belt clip for carrying the holster on the belt of the user, and a locking mechanism integrated in the case, for locking the pistol into it. The locking mechanism further includes an arm pivoted on the outer surface of the case with the aid of a shaft perpendicular to the plane formed by the side of the case and a catch formed at one end of the arm, arranged to move in front of, and away from the trigger guard with the aid of a deflection of the arm essentially perpendicular to the plane formed by the side of the case. The arm is arranged to rotate around the shaft essentially on the said plane with the aid of the movement of the user's hand, in order to release the locking mechanism. The catch includes a bevelled surface arranged to fit the trigger guard, for moving the catch away from the path in order to push the pistol into the case, and a counter-surface for securing the pistol to the case by the trigger guard. The catch further includes another bevelled surface, for guiding the catch out from inside the trigger guard with the aid of rotation. Further, the case includes an opening formed in the surface of the case, for guiding the catch inside the trigger guard. Such a locking mechanism is simple, quick to use, and reliable. The second bevelled surface is preferably perpendicular relative to the first bevelled surface. The second bevelled surface permits the catch to rise out from inside the pistol's trigger guard, when the arm of the locking mechanism is rotated.

The arm is preferably pivoted perpendicularly, relative to the side of the holster.

The catch preferably includes a first bevelled surface and a first counter surface in the longitudinal direction of the arm, as well as a second bevelled surface and a second counter surface in the direction transverse to that of the longitudinal direction of the arm. Such a catch construction permits automatic locking of the pistol when the pistol is being holstered and a rapid release of the locking when the pistol is being pulled out.

The catch is preferably arranged to extend through the opening to the inside of the pistol's trigger guard. With the aid of its trigger guard, the catch locks the pistol into the holster by force, thus making it extremely difficult, or practically impossible to remove it without rotating the arm of the locking mechanism.

The first counter-surface can be perpendicular relative to the barrel of the pistol, in order to use forced locking as an aid to prevent the pistol from being pulled out of the case. The first counter surface acts as an obstacle inside the trigger guard to the pistol being pulled out.

According to one embodiment, the arm is arranged to bend in a direction perpendicular to the side of the case when the locking mechanism is being opened. The rigidity of the arm can then act as the locking force and the locking mechanism can be implemented without a separate spring. In other words, the locking mechanism is arranged with the aid of the rigidity of the locking arm.

According to one embodiment, the locking means include additionally a slot and slot screw, the head of which slot screw being arranged to slide in the said slot. This stabilizes the movements of the arm and prevents movements of the arm in the longitudinal direction of the shaft.

According to one embodiment, the other end of the arm includes a bevel, which is shaped at a slant, in order to change the vertical movement of the user's hand into a movement around the shaft. Thus, the movement of the user's hand towards the grip of the pistol is changed into one that rotates the arm and, at the same time, one that releases the pistol from the case. The bevel can be arranged at an angle of 30-60° relative to the longitudinal direction of the arm. The movement of the user's hand in the longitudinal direction of the arm is then effectively changed into a movement that rotates the arm.

The case can be formed from rigid casing components. The casing components of the holster can be arranged to conform precisely to the shapes of the pistol. A holster assembled from rigid components will be durable and the pistol-specific shaping of the case will ensure that the pistol will sit well in the holster, making it easy to take the pistol out of the holster, nor will the pistol be able to wobble in the case when it is kept there.

On the side of the second bevelled surface of the edge of the opening can include an opening bevel, in order to facilitate the movement of the catch. With the aid of the opening bevel, the catch will rise considerably more easily out of the opening when the locking mechanism is opened.

The opposite end of the arm relative to the catch preferably extends essentially to the plane of the curve possessed by the pistol's grip. Thus, the user will rotate the arm of the locking mechanism at the same time as they grip the pistol's grip.

The catch is preferably arranged to be wedge-shaped in one direction, both in the longitudinal and in the transverse direction of the pistol's barrel. Thus, one side of the catch will permit the catch to be removed from the curved guard of the trigger while the other will, for its part, lock the pistol in place in the case using the trigger guard.

According to a second embodiment, a return spring is located in connection with the slot for locking the locking mechanism when the arm is not pushed by hand. The return spring acts as an aid to the stiffness of the arm in returning the arm to the locking position, when the pistol is pulled out of the case.

The holster according to the invention is primarily a 'concealed carry holster'. The holster is designed to conform as closely as possible to the body. Concealed holsters are intended to be worn under civil clothing, so that the weapon and its holster will not be visible to bystanders. The main user groups for concealed carry holsters are security-sector personnel trained as bodyguards, plainclothes officials, and civilians in those countries in which they are allowed by law to carry concealed weapons (for example, in certain states in the USA). The holster can also be used as a conventional visible holster and can be used by users of all kinds.

BRIEF DESCRIPTION OF THE DRAWINGS

In the following the invention is described in detail with reference to the accompanying drawings depicting some embodiments of the invention, in which.

DETAILED DESCRIPTION OF THE INVENTION

Figure 1:
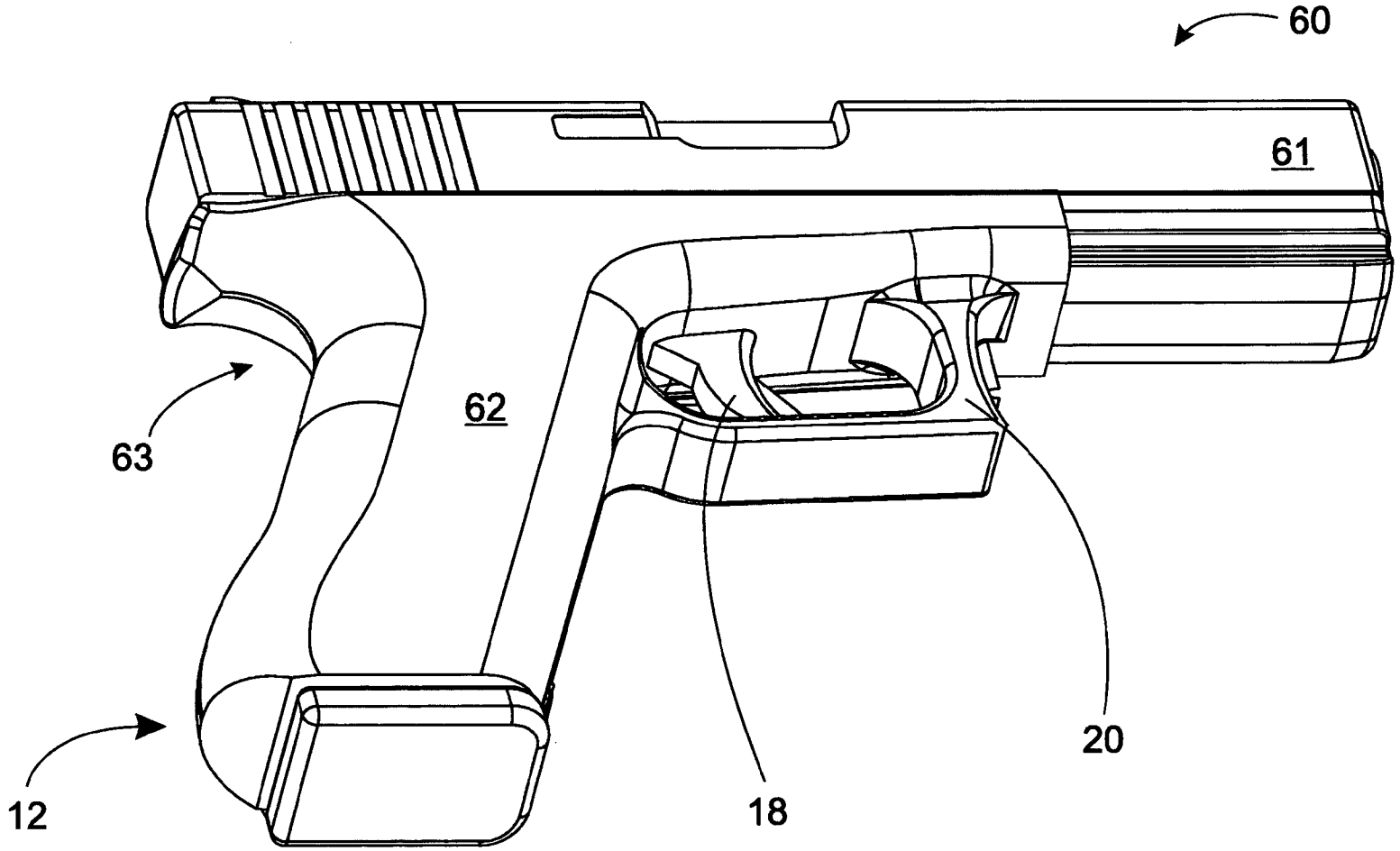
FIG. 1 shows an axonometric view of a pistol suitable for the holster according to the invention.

FIG. 1 shows one pistol, which can be kept in one embodiment of the holster according to the invention. The pistol 12 includes a barrel 60, a handgrip 62, a trigger 18, and a trigger guard 20. The model of the pistol suitable for the holster can vary considerably from the pistol shown in FIG. 1 and the holster can always be manufactured to suite the intended pistol, provided the pistol has a trigger guard.

Figure 2:
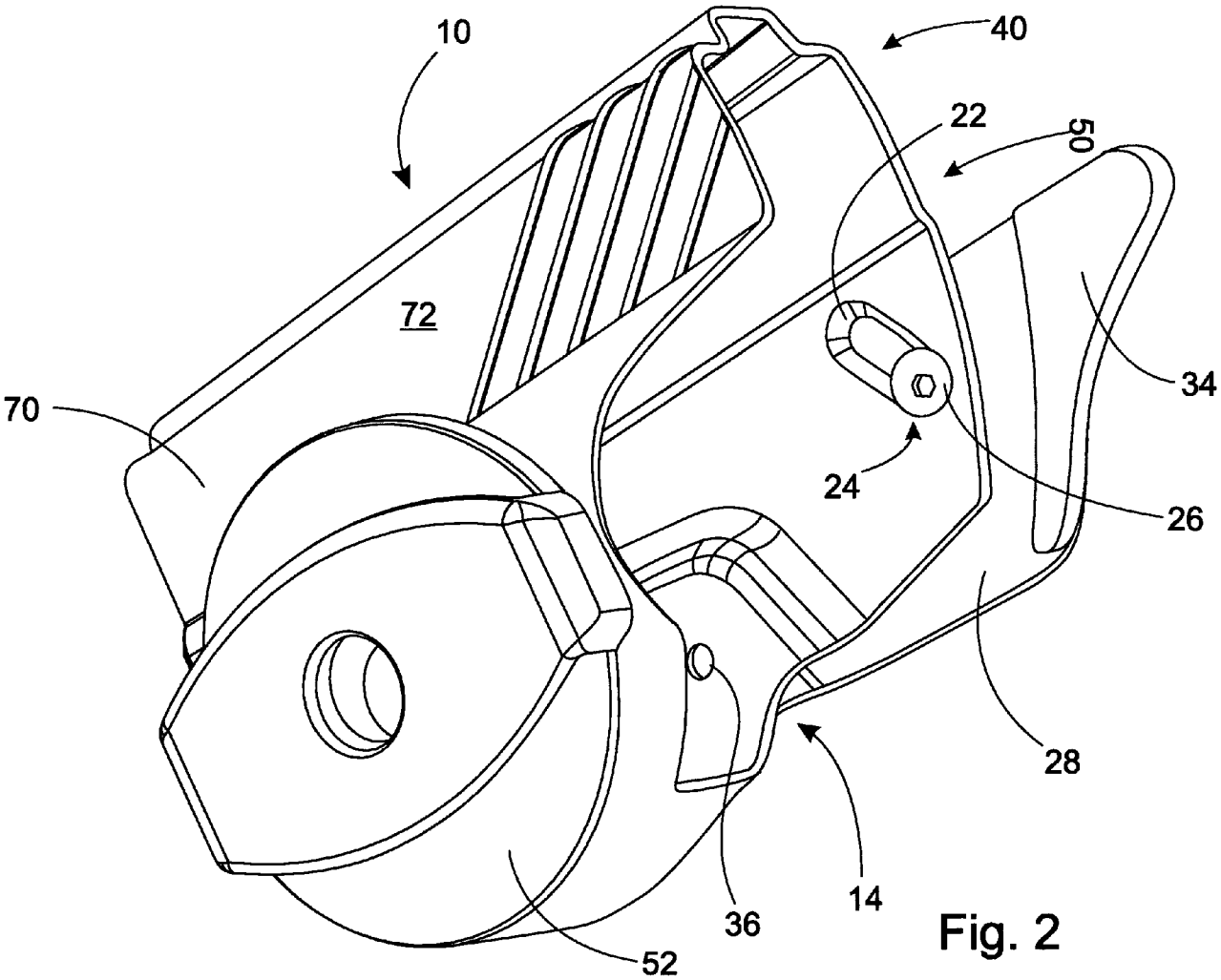
FIG. 2 shows a side view of the holster according to the invention from the belt-clip side, as an axonometric view without a pistol.
Figure 5:
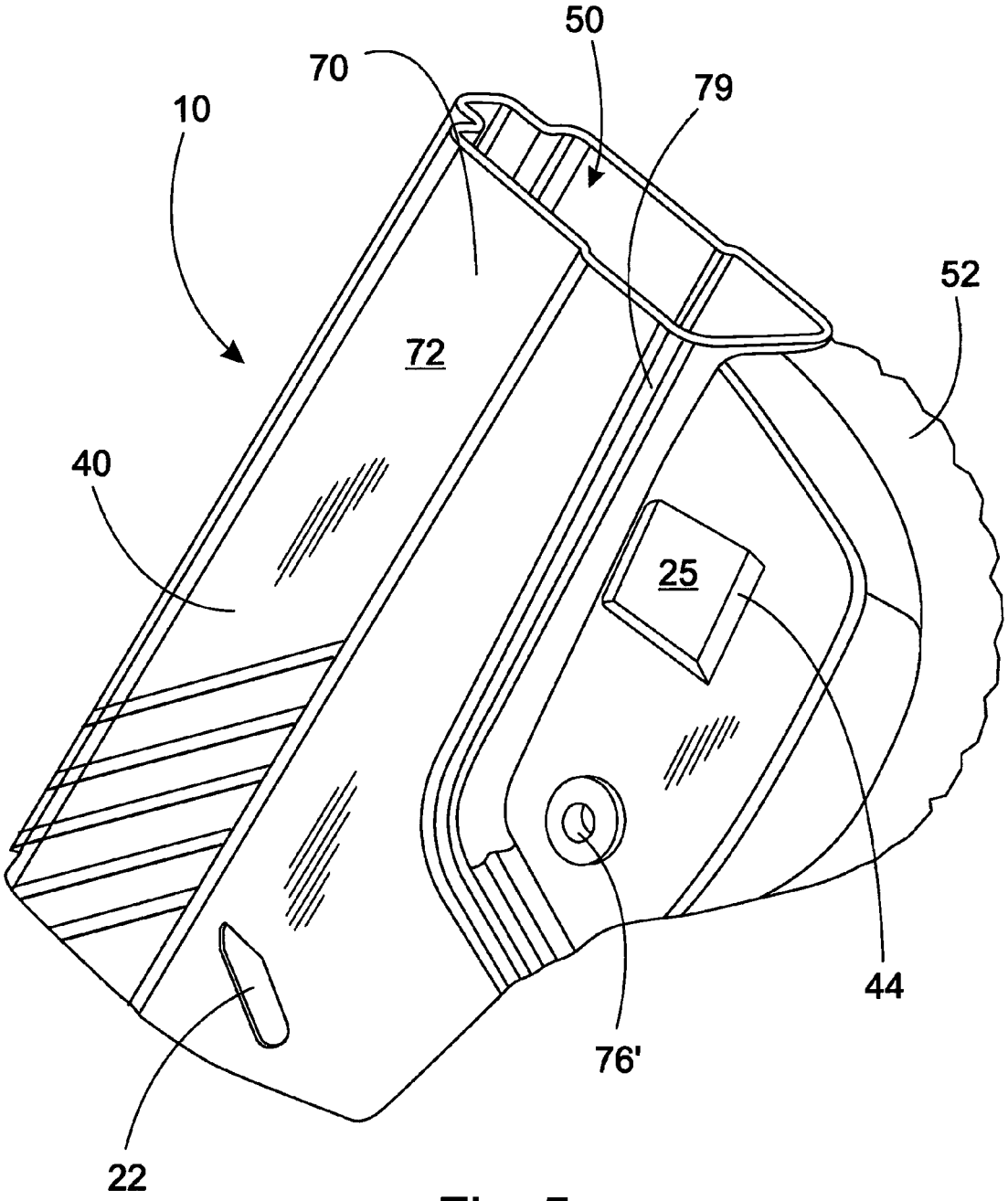
FIG. 5 shows a side view of the holster according to the invention, depicted axonometrically from the arm side without the arm and pistol.

FIG. 2 shows one preferred embodiment of the holster 10 according to the invention, without a pistol. The holster 10 consists of a case 40 formed from rigid casing components 72, a locking mechanism 14 and a belt clip 52. In the operating position, the holster 10 is open at the upper part, i.e. it includes an opening 50, through which the pistol can be pushed into the case 40. An open path is formed inside the case 40 for the pistol's trigger guard. The locking mechanism 14, for its part, includes an arm 28 of the locking mechanism 14 pivoted on a shaft 36 that is transverse relative to the side 70 of the case 40, and a catch opening 25 in the side 70 of the case 40, which is shown in FIG. 5. In this connection, reference to the side of the case refers to the surface of the case 40, which is parallel to the side of the barrel of the pistol.

The operation of the locking mechanism is based on locking the pistol into the case by locking the trigger guard of the pistol. The trigger guard is locked into the case by means of a catch belonging to the arm of the locking mechanism, which permits the trigger guard to move only inwards to the case when placing the pistol into the case. An opening, through which the catch presses into the trigger guard, is made for the catch in the side of the case. The opening of the case and the empty space inside the trigger guard form a path for the catch through which path the catch penetrates into the trigger guard. Once the edge of the trigger guard has entirely passed the catch, the catch presses inwards through the opening in the case, thus preventing the pistol from moving in a path outwards from the case, i.e. upwards in the operating position. In this connection, reference to the operating position refers to the position in which the barrel of the pistol is essentially vertical in the case. Naturally, the holster can be used in other positions too.

The force pressing the catch into the trigger guard is created with the aid of the stiffness of the arm. The arm is secured in the case with the aid of the shaft, and, at the location of the shaft, the arm cannot move in the longitudinal direction of the shaft, but only around the shaft. However, the arm bends in the longitudinal direction of the shaft, over the distance between the catch-side end of the arm and the shaft. The arm is manufactured from a flexible material, so that in the opening position of the locking mechanism it bends, thus permitting the catch to come out from the opening in the case.

The locking mechanism is released by the user pressing the arm downwards from the bevel on the arm at the same time as they grip the pistol's grip. The bevel and the shape change the direction of the downwards directed force, causing the arm to move transversely to the direction of the movement of the hand. The arm rotates around the shaft securing it, in a plane parallel to the side of the case, while the catch at the end of the arm moves in a direction perpendicular to the direction of the pistol barrel towards the edge of the opening in the case, as shown in FIGS. 6*c*, 7*c*, and 8*a*. The wedge-shaped part lifts the catch against the edge of the opening outwards from inside the pistol's trigger guard. In other words, the ridges of the catch begin to rise along the opening bevel at the edge of the opening. At the same time, the catch flexes a little. The catch moves along the opening bevel out from the opening and from inside the trigger guard, in which cae the trigger guard and through it the pistol is free to be lifted out of the holster. The various stages of the operation of the holster are depicted in FIGS. 6*a*-8*b*.

Figure 3:
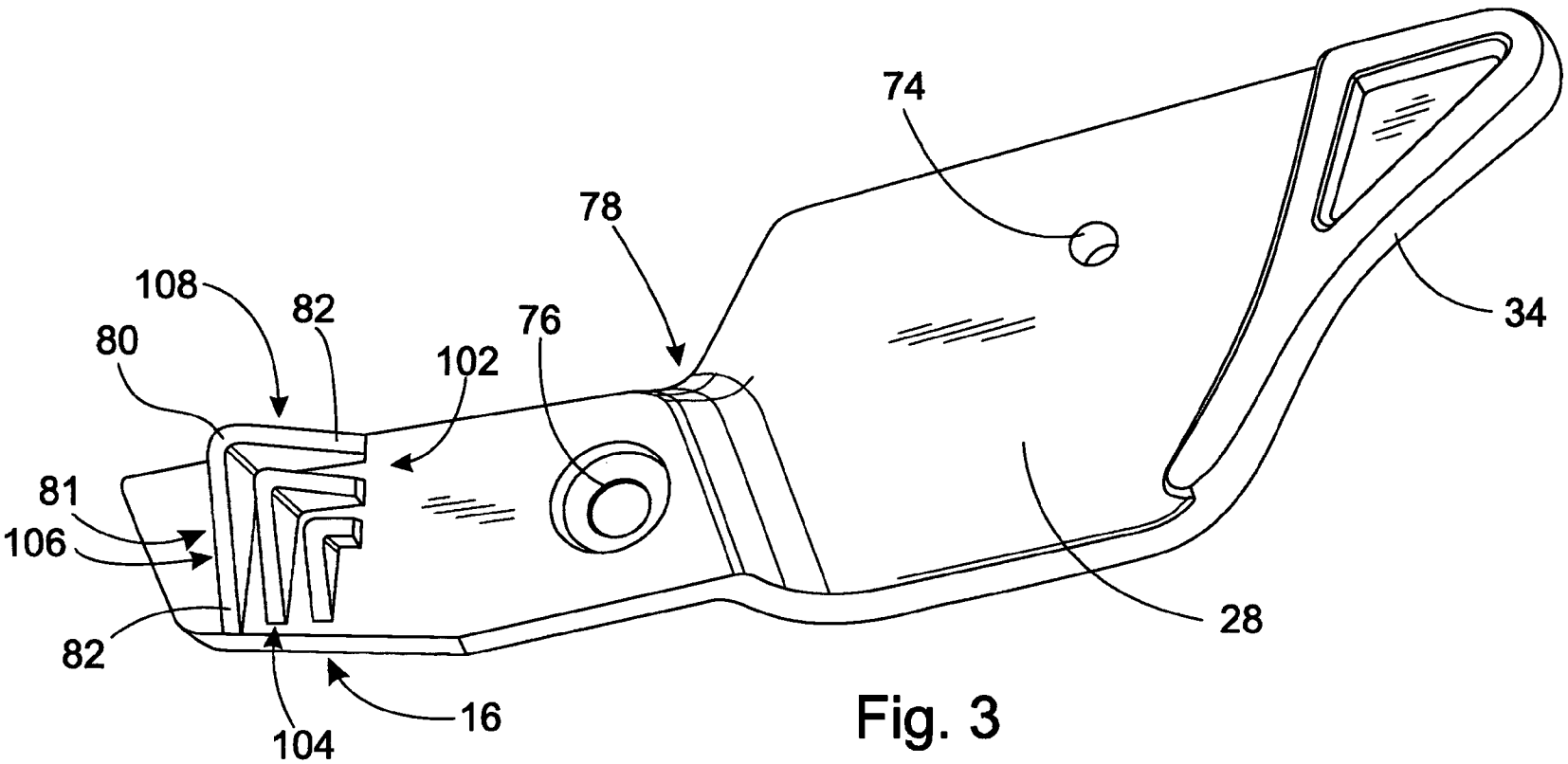
FIG. 3 shows a side view of the separated arm of the holster according to the invention, depicted axonometrically from the belt-clip side.

FIG. 3 shows the arm 28 of the locking mechanism, detached from the case 40. In the arm 28, there is a shaft opening 76 for the shaft securing the arm 28, and a screw opening 74 for the slot screw. Because the pistol's trigger guard is narrower than the pistol's barrel, there should be a rounding 78 in the arm 28, which conforms to the shape of the case. With the aid of the rounding 78, the upper part of the arm rotates from the case at the location of the pistol barrel and, at the same time, the arm 28 is made to conform to the shapes of the pistol and the case.

FIG. 3 also shows in greater detail one preferred construction of the catch 16 of the arm 28. In this embodiment, the catch 16 is wedge-shaped in two directions, i.e. it is formed from two bevelled surfaces 102 and 104, which are perpendicular to each other, and of two counter-surfaces 106 and 108, which are also perpendicular to each other. The catch 16 itself can be formed of ridges 81, which have lower parts 82 and an upper part 80. The ridges 81 are preferably shaped as a right angle, or in other words are L-shaped. The ridges can be as in FIG. 3, or in some cases the ridges can also be unified, in which case the entire catch will be a single piece. The ridges 81 preferably rise evenly from the lower parts 82 towards the upper part 80. The maximum height of a ridge from the level of the surface of the arm can be, for example, about one-third of the width of the pistol's trigger guard, so that the catch secures the pistol effectively with the aid of the trigger guard. In that case, the deflection of the arm 28 too when the pistol is being holstered will also remain relatively small. The purpose and operation of the bevelled surface of the catch 16 is described in greater detail in connection with FIGS. 6*a*-8*b*.

According to FIG. 2, the arm 28 is attached to the case 40 not only by means of the shaft 36, but also partly by means of the slot screw 24 in the slot 22. The head 26 of the slot screw is wider than the slot 22, so that the slot screw 24 can move only in the longitudinal direction of the slot 22. Thus, the paths of the arm are restricted with the aid of the slot, and the arm cannot escape to the wrong position, even when the locking mechanism is released.

According to one embodiment, in connection with the slot there can be a return spring, which pushes the slot screw so that the arm returns immediately to the locking position once if it is not pushed by the hand to the release position. The return spring assists the locking mechanism that returns mainly with the aid of the stiffness of the arm.

Figure 4:
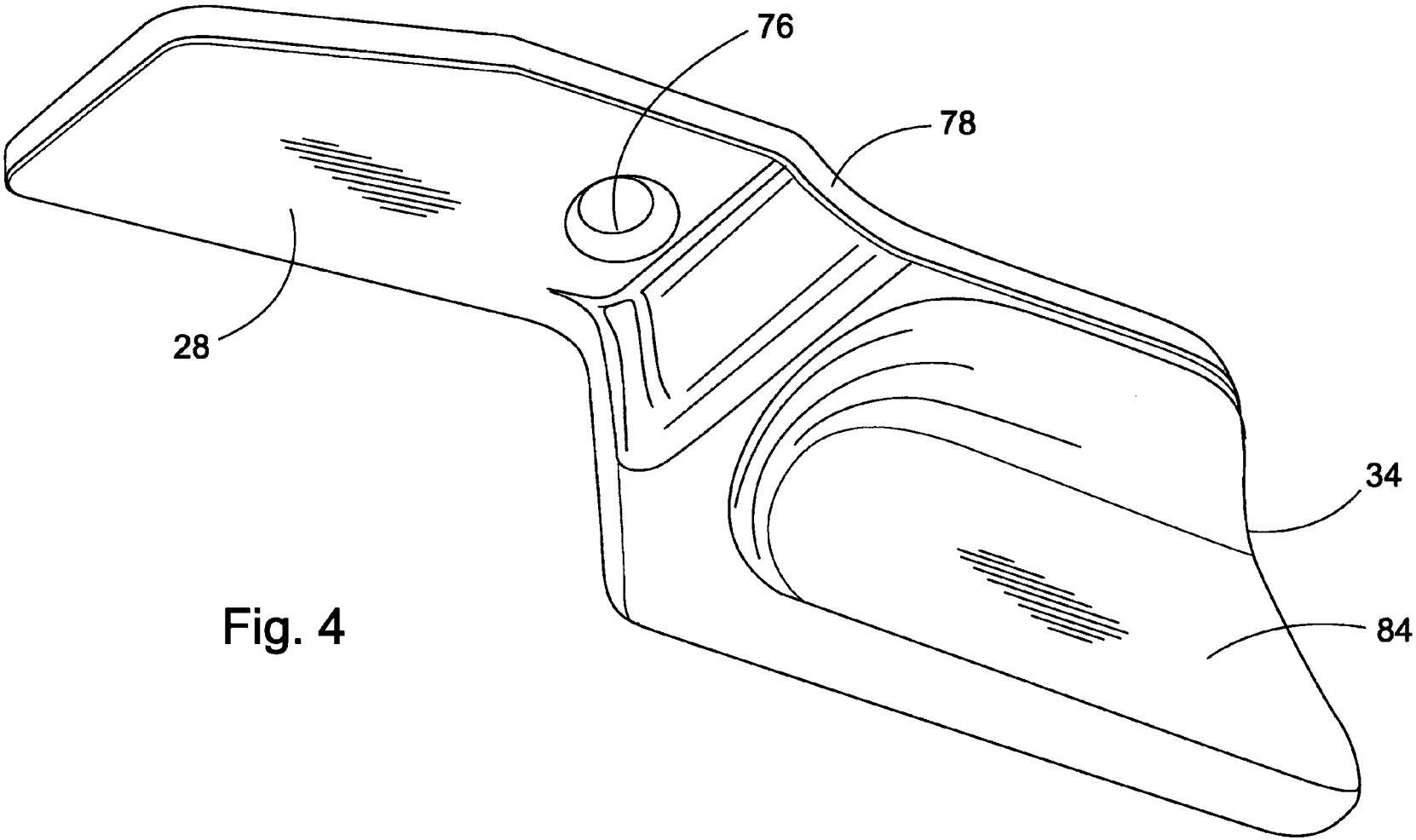
FIG. 4 shows a side view of the separated arm of the holster according to the invention, depicted axonometrically from the side opposite to the belt-clip side.

FIG. 4 shows the arm 28 seen from the other side, without the case. It can be seen from the figure that the upper part of the arm 28 includes shaping 84, the purpose of which is the same as that of the bevel 34, i.e. to assist the movement of the hand of the user to rotate the arm 28 around the shaft, in order to release the locking mechanism. The shaping 84 can be a recess or similar made in the arm 28.

FIG. 5 shows the case 40 of the holster without the pistol and arm. The figure shows the shaft lug 76' and the slot-screw slot 22 made in the case. The essential feature in the figure is the catch opening 25, which acts as a feed-through in the case for the catch. At the side of the opening, there is an opening bevel 44, which is arranged to facilitate the movement of the catch out of the catch opening 25. The opening bevel 44 is at the side of the second bevel surface of the catch in the catch opening 25, which facilitates the movement of the catch out of the catch opening 25 when the arm is rotated. The catch opening 25 is preferably located in the case 40 at the position of the space delimited by the pistol's trigger guard. The catch opening 25 is preferably either a rectangle or a square, but it can also have a different shape, depending on the shape of the catch. In the casing component 72, there is a widening 79 for the pistol barrel, which is essentially of the same shape as the rounding of the arm.

FIGS. 6*a*-8*b* show a preferred embodiment of the holster and its operation. According to FIGS. 6*a*-8*b*, when the trigger 18 guard 20 of the pistol 12 moves in the longitudinal direction of the arm 28, from the end next to the bevel of the arm 28 towards the other end, the trigger first of all encounters the first bevelled surface 102. The first bevelled surface 102 is bevelled in a plane that intersects the plane of the side 61 of the barrel 60 of the pistol 12, in such a way that the intersection of the planes is perpendicular to the longitudinal direction of the pistol's 12 barrel 60. The angle between the planes can be 20-60°, preferably 30-40°, so that the angle of the rise will not be excessive.

If an attempt is made to pull the pistol 12 out of the holster 10 without first of all rotating the arm 28 of the locking mechanism 16, the part of the trigger guard 20 on the side of the end of the barrel 60 will first of all meet the first counter-surface 106. The first counter-surface 106 is a surface perpendicular to the side 61 of the barrel 60 of the pistol 12, which is also perpendicular to the longitudinal direction of the barrel 60 of the pistol 12. The first counter-surface 106 prevents the pistol 12 from being pulled out of the holster 10 without the rotation of the arm 28 of the locking mechanism 16. When rotating the arm 28 around its shaft 36 during the opening of the locking mechanism, the second bevelled surface 104 of the catch 16 first of all meets the opening bevel 44 of the opening. The second bevelled surface 104 is bevelled in a plane that intersects the plane of the catch opening 25, in such a way that the intersection of the planes is parallel to the barrel 60 of the pistol 12. The angle between the planes can be 20-60°, preferably 30-40°. The second bevelled surface 104 changes the movement of the user hand rotating the arm 28 around its shaft 36 to become parallel to the shaft 36, so that the catch 16 comes out from inside the pistol's 12 trigger 18 guard 20. Correspondingly, when the arm 28 rotates back in the opposite direction, the arm 28 rotates until the second counter-surface 108 touches the edge of the catch opening 25. This counter-surface 108 is a surface perpendicular to the plane of the opening 25, which prevents the arm 28 from rotating the catch 16 past the catch opening 25.

The wedge shaping of the catch 16 in two directions has three functions. The first function is to permit the pistol 12 to be placed into the holster 10 according to FIGS. 6*a*, 7*a*, and 8*a*, when the trigger guard 20 will be able to slide along the first bevelled surface 102 of the catch 16 on a path into the case 40. The arm 28 flexes in the direction of its shaft 36, until the pistol's 12 trigger guard 20 passes the first bevelled surface 102 and the catch 16 locks the trigger guard 20 with the aid of the first counter-surface 106. The arm 28 should be arranged to be flexible, so that the catch 16 will move out of the road of the pistol's 12 trigger guard 20 when the pistol 12 is being holstered.

The second function is a function relating to a movement perpendicular to the direction of the movement of the pistol 12 taking place in the holster 10, i.e. the opening of the locking mechanism, which is shown in FIGS. 6*c*, 7*c*, and 8*c*. When the locking mechanism 14 is opened with the aid of the arm 28, the catch 16 must be able to rise from inside the trigger guard 20 and out of the catch opening 25, which takes place along the second bevelled surface 104. When the arm 28 is rotated, the catch 16 moves in the longitudinal direction of the pistol's 12 barrel 60 and in a direction perpendicular to the shaft 36 of the arm 28, when the second bevelled surface 104 slides along the opening bevel 44 of the catch opening 25. The locking mechanism 14 returns automatically to its locking position, by exploiting the stiffness of the flexible arm 28 or possibly a return spring. The stiffness of the arm 28 should be adapted in such a way that it is sufficient to return the locking mechanism 14 to the locking position, but is nevertheless also sufficient to permit the pistol to be holstered.

Figure 6A:
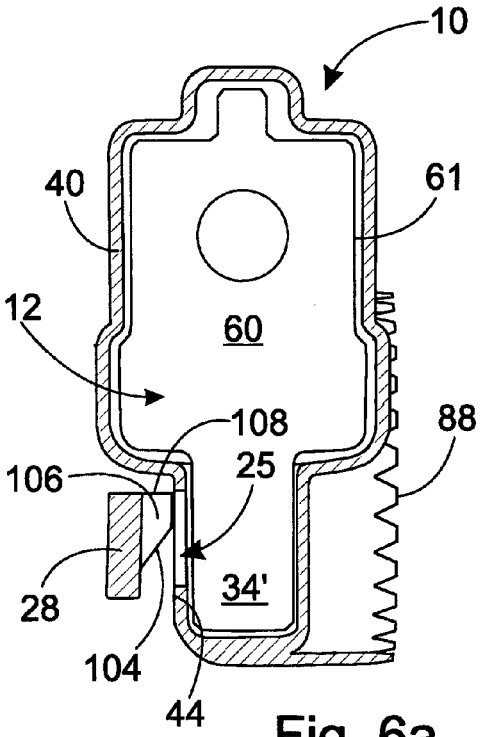
FIGS. 6*a*-6*c* show a bottom view of the operation of the locking mechanism, depicted as a cross-section.
Figure 6B:
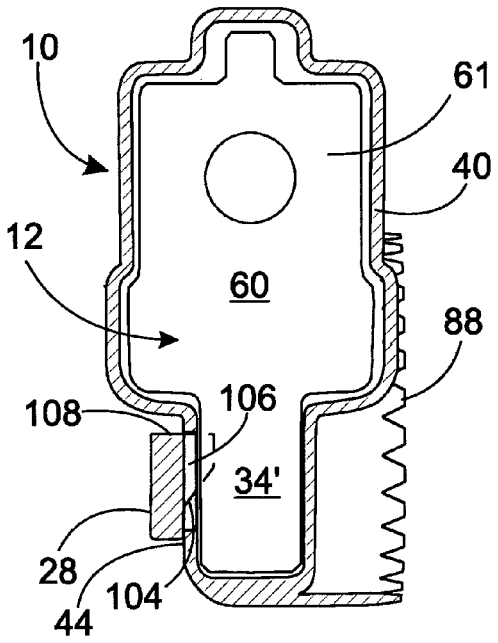
Figure 6C:
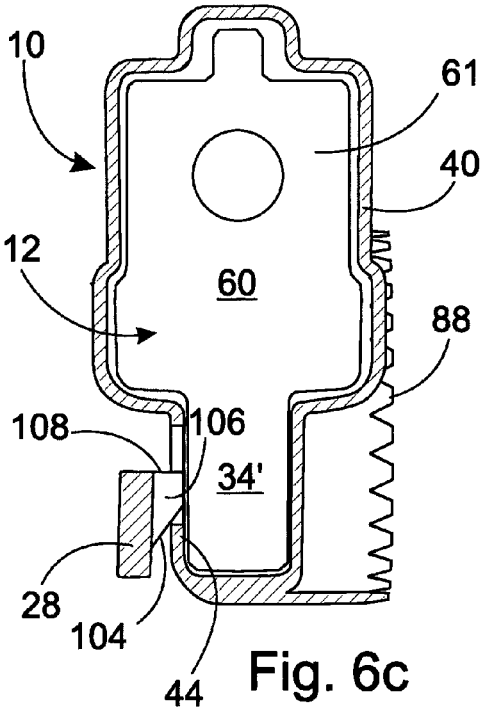
Figure 7A:
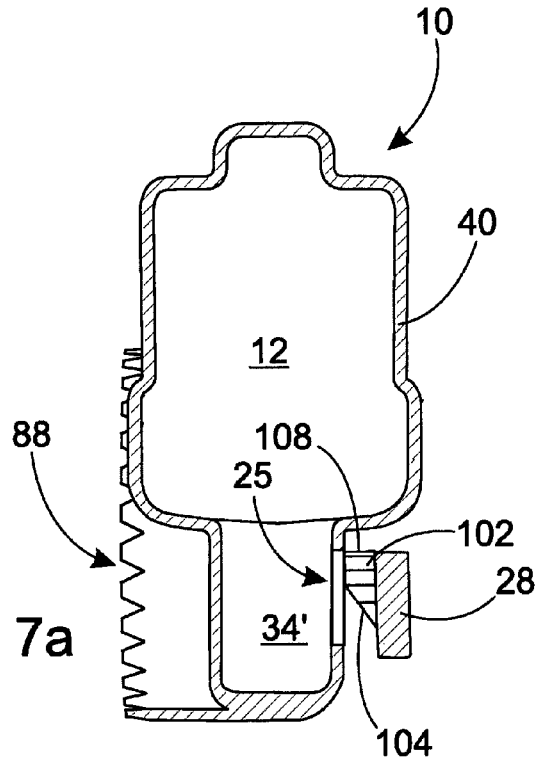
FIGS. 7*a*-7*c* show a top view of the operation of the locking mechanism, depicted as a cross-section.
Figure 7B:
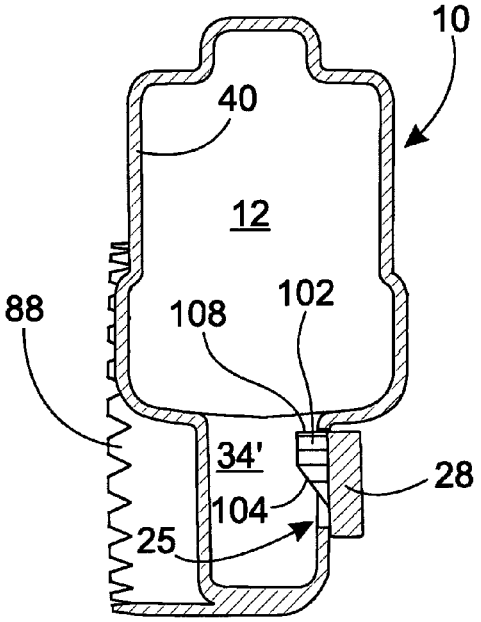
Figure 7C:
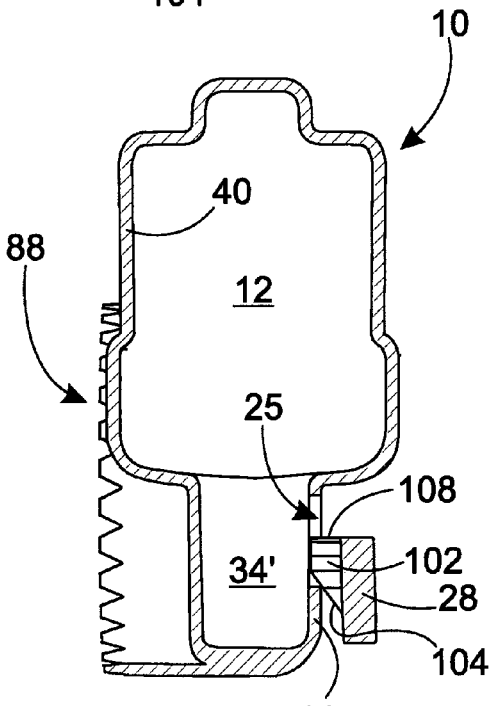
Figure 8A:
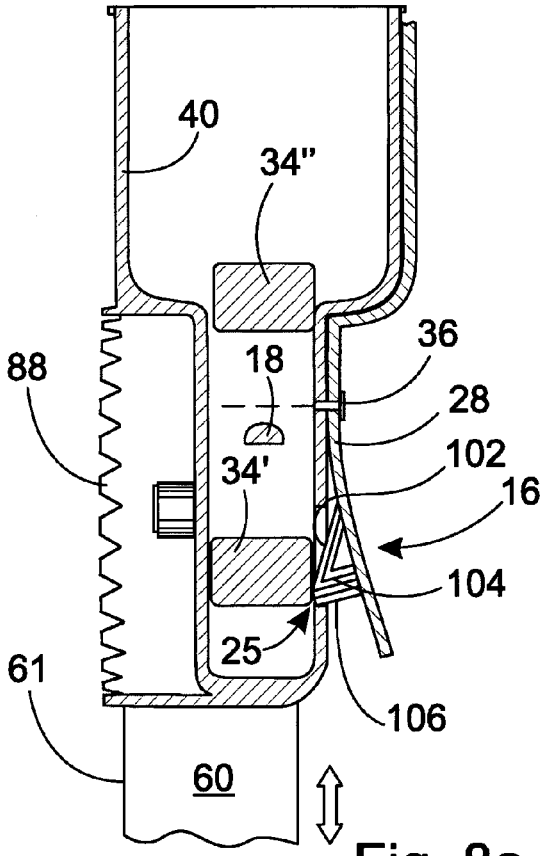
FIGS. 8*a*-8*b* show a view from the grip of the pistol, of the locking mechanism, depicted as a cross-section.
Figure 8B:
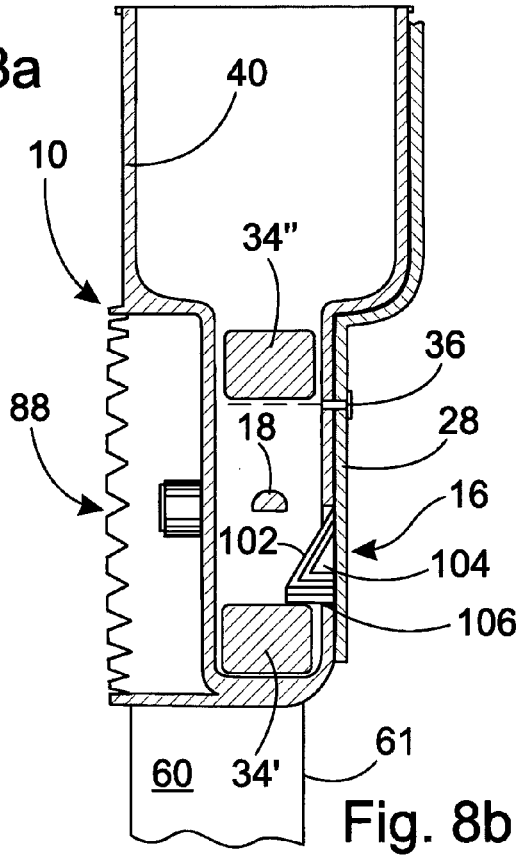
Figure 9:
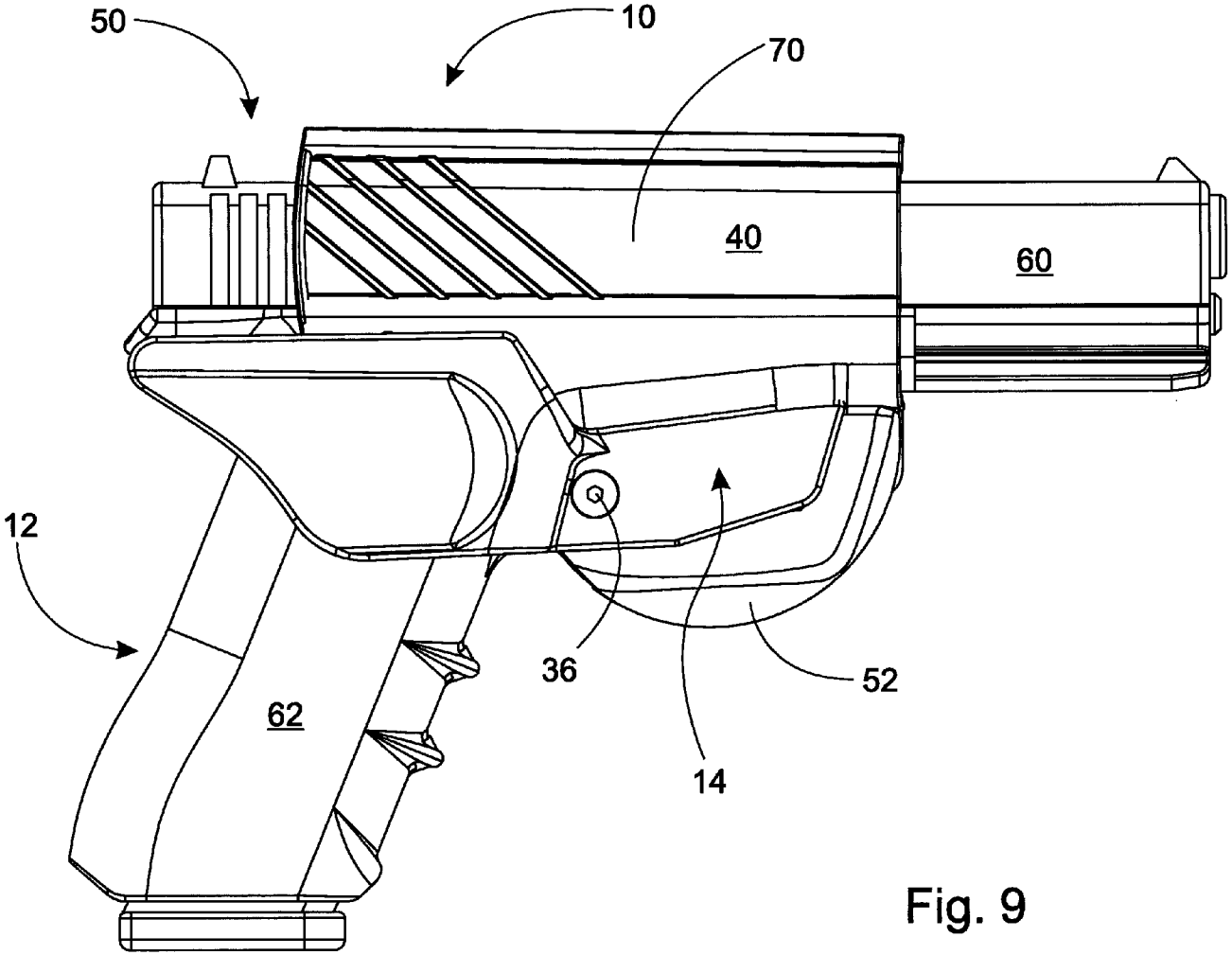
FIG. 9 shows a side view of the holster according to the invention, with the pistol in the case.
Figure 10:
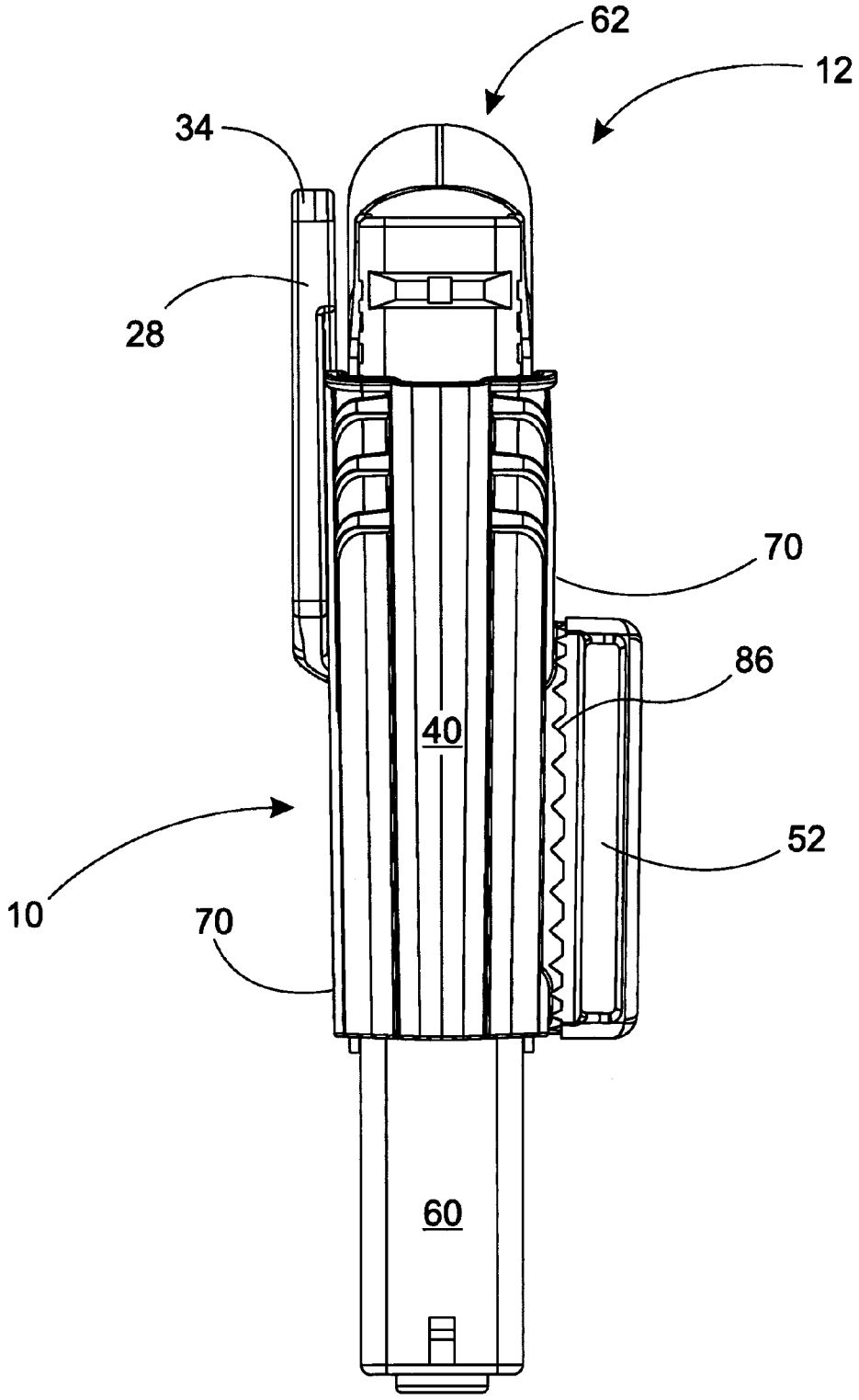
FIG. 10 shows a view of the holster according to the invention, depicted from the front of the user with the pistol in the case.

The third function of the catch 16 is to prevent the pistol 12 being pulled out of the holster 10 without the rotation of the arm 28, as shown in FIGS. 6*b*, 7*b*, and 8*b*. When the pistol 12 is in the holster 10, the counter-surface 108 of the catch 16 is essentially parallel to the trigger guard 20 and in front of the trigger guard 20. Only by rotating the arm 28 can the counter-surface 108 be moved to the side from in front of the trigger guard 20.

FIGS. 9-14 show the holster 10 when the pistol 12 is locked into it. According to FIG. 9, the case 40 of the holster 10 covers only part of the pistol 12, more precisely at least the trigger and the trigger guard of the pistol. According to FIG. 10, the belt-clip 52 can include toothed adjustment plates 86 for setting the holster 10 to the desired angle relative to the belt. The main components of the holster are attached to each other by means of screws, which permit servicing of the mechanism. In addition, spare parts can be purchased for the holster, if some component becomes damaged in use.

Figure 11:
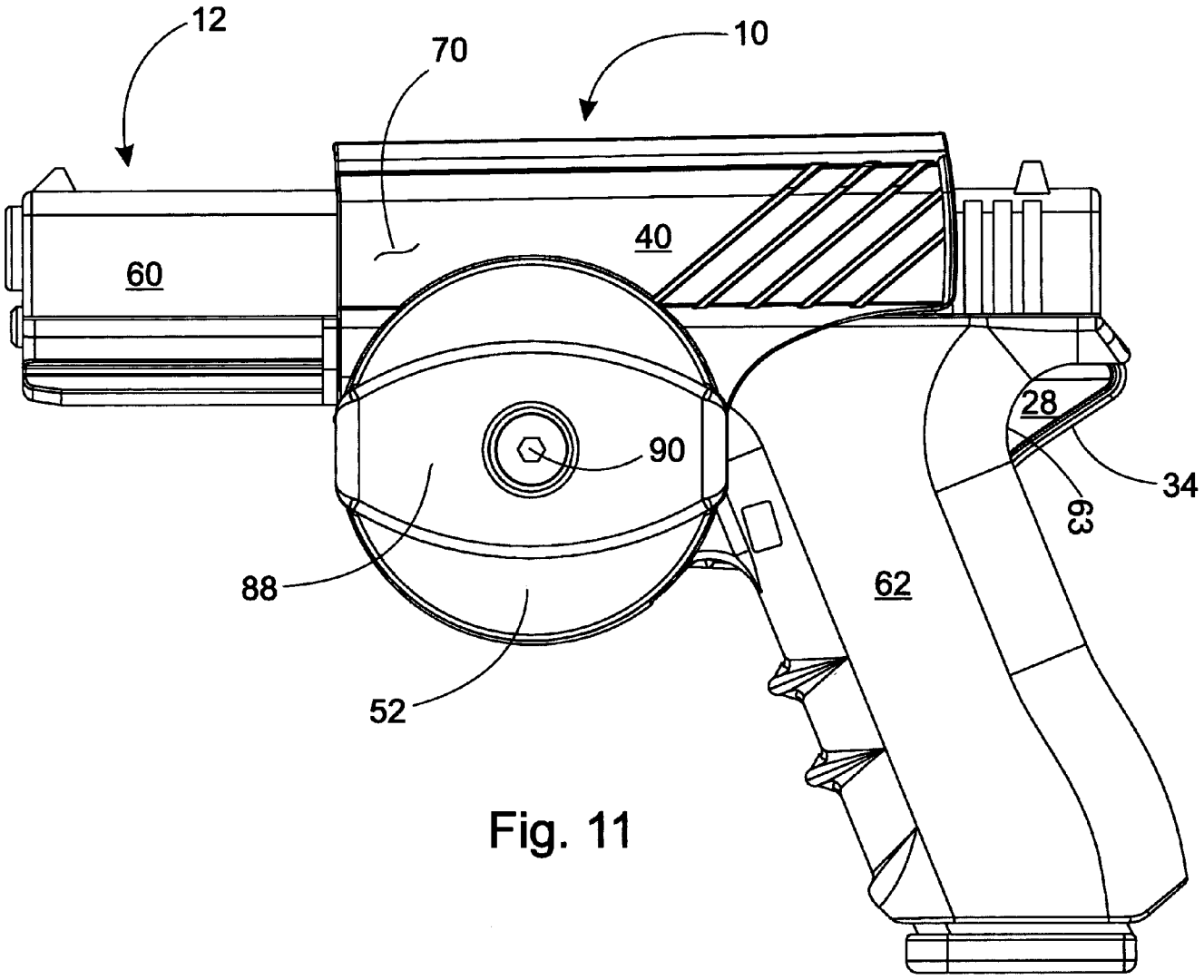
FIG. 11 shows a side view of the holster according to the invention, depicted from the belt-clip side, with the pistol in the case.

According to FIG. 11, the belt clip 52 includes a belt loop 88 and a tightening bolt 90. The user's belt is placed through the belt loop 88 and the belt clip is locked into the desired position with the aid of the tightening bolt 90. The figure shows how the grip 62 of the pistol 12 remains completely free for the user's palm. Thus, the pistol can be quickly released from the holster when the need to use it arises, as the construction of the holster permits unobstructed direct access to the pistol's grip.

Figure 12:
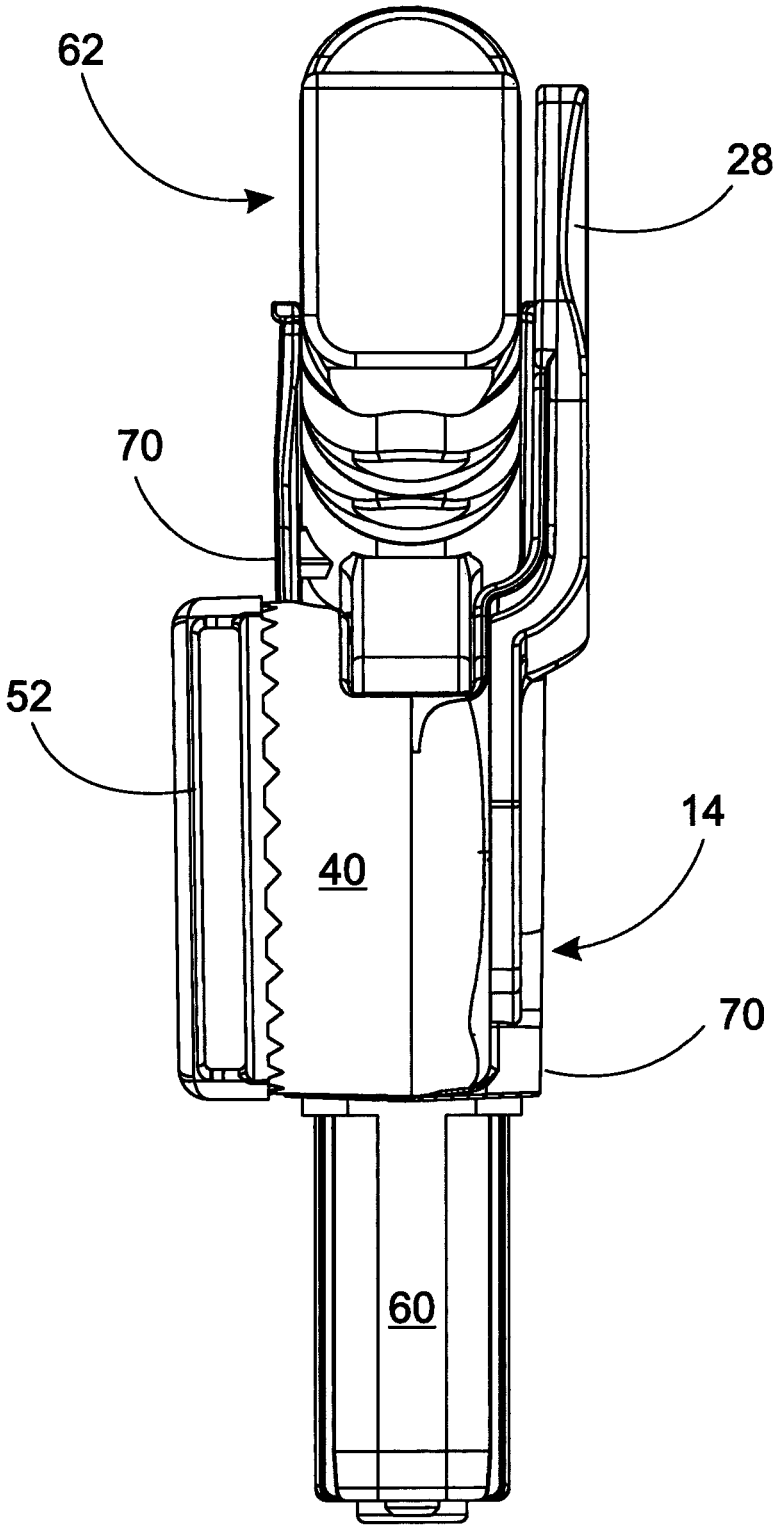
FIG. 12 shows a view of the holster according to the invention, depicted from behind the user, with the pistol in the case.

FIG. 12 shows the dimensions of the arm 28 belonging to the locking mechanism 14. The arm 28 extends from the lower part in the operation position of the case 40 to the plane of the pistol's grip 62. The arm 28 can be easily operated by the user with the same hand that they use to grip the pistol's grip 62. The movement of the user's hand in the direction of the pistol's 12 barrel 60, by means of which they grip the pistol's grip 62, is also the same movement, with the aid of which the user's hand rotates the arm 28 of the locking mechanism 14. Thanks to the long arm 28, the user also obtains sufficient torque around the shaft, so that the locking mechanism 14 is easy to release.

Figures 13A, 13B:
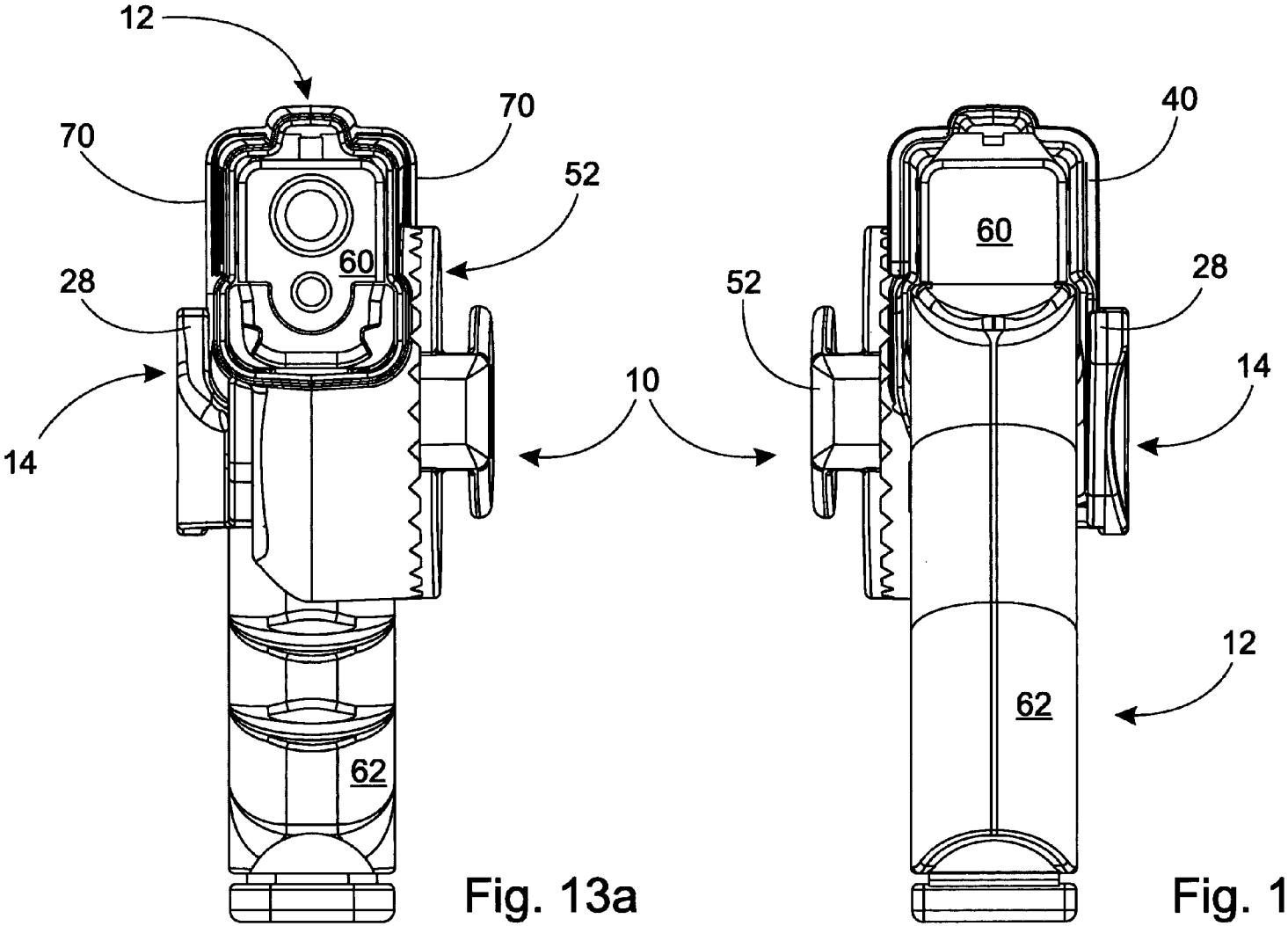
FIG. 13*a* shows a bottom view of the holster according to the invention, with the pistol in the case.
FIG. 13*b* shows a top view of the holster according to the invention, with the pistol in the case.

The small size of the holster 10 can be easily seen in FIGS. 13*a* and 13*b*. The total width of the holster can be less than twice the width of the pistol, so that the totality is really small. The small size improves the usability of the holster, as users have generally also other security devices on their belt, such as a pepper spray, handcuffs, or a remote stunner, so that the total weight of the security devices easily becomes large. Due to its small size, the holster is noticeably light in weight. Further, through its small size the holster is easy to conceal under clothes and is not noticed. The holster can be manufactured, for example, from a polymer mixture, which is light and durable, which is important in the intended use of the holster.

Figure 14:
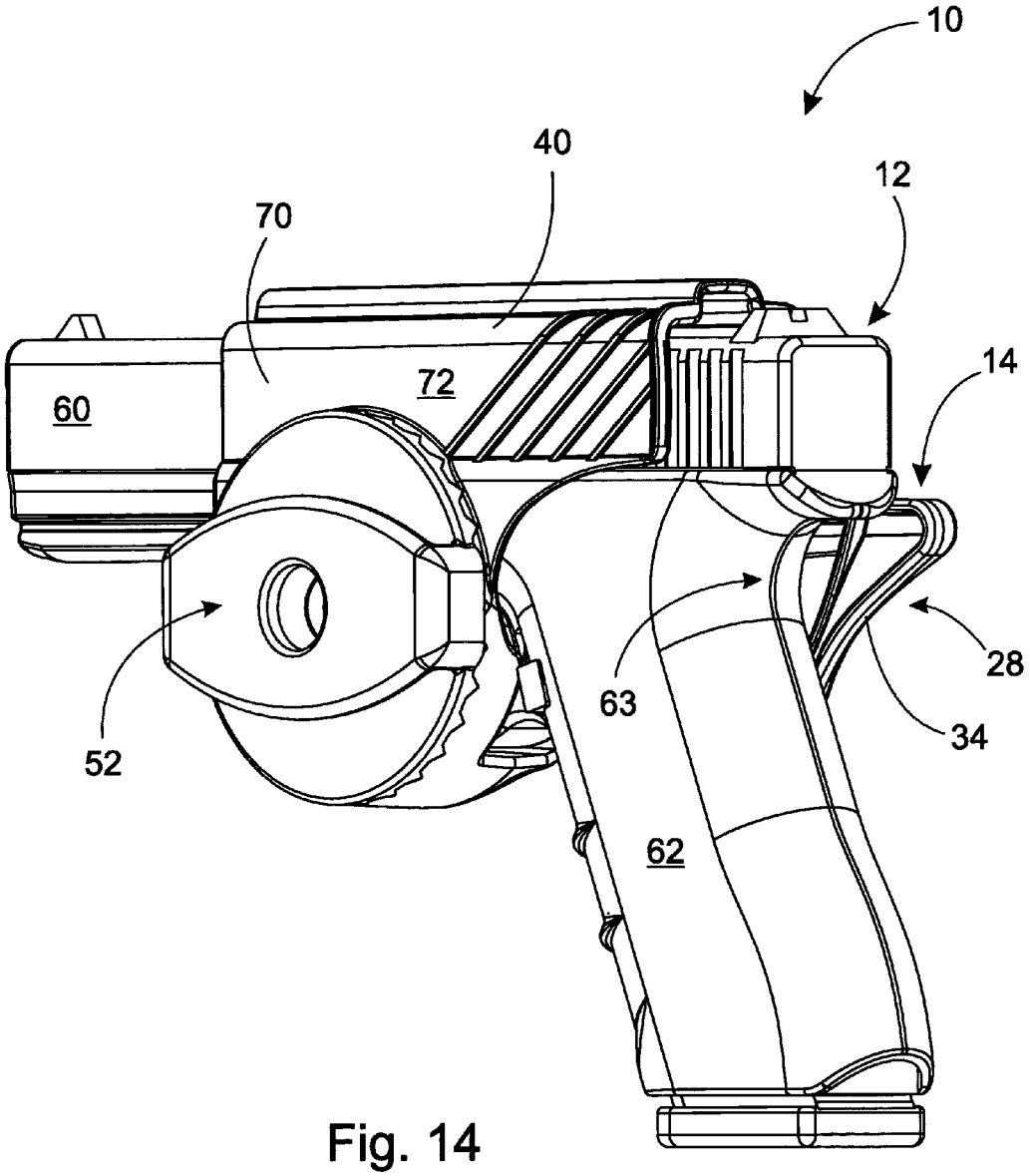
FIG. 14 shows an axonometric view of the holster according to the invention, with the pistol in the case.

FIG. 14 shows an axonometric view of the pistol 12 in the holster 10. The figure shows how the end of the arm 28 opposite to that of the catch, and its bevel 34 extend essentially at least to the plane of the curve 63 in the grip 62 of the pistol 12. The movement of the user's hand gripping the grip 62 of the pistol then also at the same time releases the locking mechanism by rotating the bevel 34. The bevel 34 is preferably formed at the other end of the arm 28. The bevel 34 can be at an angle of 30-60° relative to the longitudinal direction of the arm 28, preferably at an angle of 40-50°. With the aid of the bevel, the movement of the user's hand towards the pistol can be changed into a movement of the arm around the shaft, when the locking mechanism is released. The figure also shows how the casing components 72 of the case 40 are shaped to conform to the outer shapes of the pistol.

The holster according to the invention can be implemented using any counter-surface whatever in the pistol, instead of the pistol's trigger guard. The counter-surface must have a route, into which the catch penetrates, locking the pistol into the holster with the aid of the counter-surface.

The invention claimed is:

1. Holster for a pistol, in which pistol there is a grip, a barrel, a trigger, and a trigger guard, the holster comprising:

a rigid case partly surrounding at least the barrel and the trigger guard, the case having an upper part, an outer surface and a side, and in the upper part of the case there is an opening for pushing the pistol barrel-first into it, thus forming a path for the trigger guard, a belt clip for carrying the case on the belt of the user, a locking mechanism integrated in the case for locking the pistol into it, the locking mechanism further comprising an arm pivoted with the aid of a shaft to the outer surface of the case and a catch formed at one end of the said arm, arranged for moving in front of, and away from the trigger guard with the aid of a deflection of the arm in a direction essentially perpendicular to the plane formed by the side of the case, the catch comprising a first bevelled surface arranged to fit the trigger guard, for moving the catch away from the said path in order to push the pistol into the case, and a first counter-surface for securing the pistol to the case by the trigger guard, a catch-opening formed in the surface of the case, for guiding the catch inside the said trigger guard, wherein the said shaft is perpendicular to the said plane and the said arm is arranged to rotate around the said shaft on essentially the said plane in order to release the locking mechanism with the aid of the movement of the user's hand, and the catch comprising a second bevelled surface for guiding the catch away from inside the trigger guard with the aid of the said rotation.

2. Holster according to claim 1, wherein the said second bevelled surface is perpendicular to the first bevelled surface.

3. Holster according to claim 1, wherein the said arm is pivoted perpendicularly relative to the side of the case.

4. Holster according to claim 1, wherein the said catch comprising the first bevelled surface and the first counter-surface in the longitudinal direction of the arm and the second bevelled surface and the second counter-surface in the direction transverse to the longitudinal direction of the arm.

5. Holster according to claim 1, wherein the said catch is arranged to extend through the catch-opening and into the trigger guard of the pistol.

6. Holster according to claim 1, wherein the said first counter-surface is perpendicular to the barrel of the pistol, in order to prevent the pistol being pulled out of the holster, with the aid of forced locking.

7. Holster according to claim 1, wherein the arm is arranged to bend in a direction perpendicular to the side of the case when the locking mechanism is opened.

8. Holster according to claim 1, wherein the locking means comprising, in addition, a slot and a slot screw, the head of which slot screw being arranged to slide in the said slot.

9. Holster according to claim 8, wherein a return spring is located in connection with the slot, in order to lock the locking mechanism.

10. Holster according to claim 1, wherein the other end of the arm comprising a bevel, which is shaped at a slant, in order to change the vertical direction of the user's hand into a movement around the shaft.

11. Holster according to claim 10, wherein the said bevel is arranged at an angle of 30-60° relative to the longitudinal direction of the arm.

12. Holster according to claim 1, wherein the case is formed from rigid casing components.

13. Holster according to claim 12, wherein the casing components of the holster are arranged to conform precisely to the shapes of the pistol.

14. Holster according to claim 1, wherein on the side of the second bevelled surface of the edge of the said catch-opening the catch includes an opening bevel, in order to facilitate the movement of the catch.

15. Holster according to claim 1, wherein the end of the arm opposite to the catch extends essentially to the plane of the curve belonging to the grip of the pistol.

* * * * *